US007504372B2

(12) United States Patent
Reinhardt et al.

(10) Patent No.: US 7,504,372 B2
(45) Date of Patent: Mar. 17, 2009

(54) MIXTURES OF BLEACHING AGENTS

(75) Inventors: Gerd Reinhardt, Kelkheim (DE); Georg Borchers, Bad Nauheim (DE)

(73) Assignee: Clariant Produkte (Deutschland) GmbH, Frankfurt (DE)

( * ) Notice: Subject to any disclaimer, the term of this patent is extended or adjusted under 35 U.S.C. 154(b) by 0 days.

(21) Appl. No.: 11/662,305

(22) PCT Filed: Sep. 3, 2005

(86) PCT No.: PCT/EP2005/009490

§ 371 (c)(1),
(2), (4) Date: Mar. 8, 2007

(87) PCT Pub. No.: WO2006/027179

PCT Pub. Date: Mar. 16, 2006

(65) Prior Publication Data

US 2008/0105850 A1 May 8, 2008

(30) Foreign Application Priority Data

Sep. 8, 2004 (DE) ..... 10 2004 043 361
Nov. 9, 2004 (DE) ..... 10 2004 053 971

(51) Int. Cl.
*C11D 10/00* (2006.01)

(52) U.S. Cl. ..... 510/375; 252/186.42

(58) Field of Classification Search ..... 252/186.1, 252/186.42; 510/375
See application file for complete search history.

(56) References Cited

U.S. PATENT DOCUMENTS

| | | | | |
|---|---|---|---|---|
| 3,163,606 | A | 12/1964 | Wilhelmas | |
| 3,234,158 | A | 2/1966 | Pfluger | |
| 3,945,936 | A * | 3/1976 | Lucas et al. | 252/186.2 |
| 4,130,392 | A * | 12/1978 | Diehl et al. | 8/101 |
| 4,391,723 | A * | 7/1983 | Bacon et al. | 510/297 |
| 4,536,314 | A | 8/1985 | Hardy | |
| 4,619,779 | A | 10/1986 | Hardy | |
| 5,061,807 | A | 10/1991 | Gethoeffer | |
| 5,075,041 | A | 12/1991 | Lutz | |
| 5,318,733 | A | 6/1994 | Carduck | |
| 5,512,699 | A | 4/1996 | Connor | |
| 5,520,844 | A | 5/1996 | Venturello | |
| 5,534,197 | A | 7/1996 | Scheibel | |
| 5,575,947 | A | 11/1996 | Venturello | |
| 5,616,550 | A | 4/1997 | Kruse | |
| 5,688,434 | A | 11/1997 | Venturello | |
| 5,840,667 | A * | 11/1998 | Milne et al. | 508/334 |
| 5,843,879 | A | 12/1998 | Matsunaga | |
| 5,888,955 | A | 3/1999 | Foley | |
| 5,994,284 | A | 11/1999 | Gethoeffer | |
| 6,017,865 | A * | 1/2000 | Hartshorn et al. | 510/313 |
| 6,080,710 | A * | 6/2000 | Withenshaw et al. | 510/312 |
| 6,413,929 | B1 * | 7/2002 | Wehlage et al. | 510/500 |
| 6,444,634 | B1 | 9/2002 | Mason | |
| 2003/0073591 | A1 * | 4/2003 | Norwood et al. | 510/117 |
| 2004/0067322 | A1 * | 4/2004 | Baker et al. | 427/421 |
| 2004/0147423 | A1 * | 7/2004 | Scialla et al. | 510/372 |
| 2005/0107282 | A1 * | 5/2005 | Ford et al. | 510/438 |
| 2005/0222004 | A1 * | 10/2005 | Gagliardi et al. | 510/376 |
| 2006/0049077 | A1 | 3/2006 | Fregonese | |

FOREIGN PATENT DOCUMENTS

| | | |
|---|---|---|
| DE | 229 696 | 11/1985 |
| DE | 253 634 | 8/1988 |
| DE | 100 20767 A1 | 1/2002 |
| EP | A 0257 700 | 3/1988 |
| EP | A 0337264 | 10/1989 |
| GB | 2323371 | 9/1998 |
| WO | WO 95/19955 | 7/1995 |
| WO | WO 98/17760 | 4/1998 |
| WO | WO 02/083829 | 10/2002 |

OTHER PUBLICATIONS

English Language Machine Translation of DE 10020767 A1, Abstract, Description and claims, Jan. 17, 2002.
International Search Report for PCT/EP2005/009490, mailed Nov. 24, 2005.
Copending U.S. Appl. No. 11/662,311, Mar. 8, 2007.
English Language Abstract of EP A 0337264, Oct. 18, 1989.
Machine Language Translation of Description of EP A 0337264, Oct. 18, 1989.
English Language Abstract of Japanese Publication JP 07238298, Sep. 12, 1995.

* cited by examiner

*Primary Examiner*—Douglas Mc Ginty
*Assistant Examiner*—Haidung Nguyen
(74) *Attorney, Agent, or Firm*—Richard P. Silverman

(57) ABSTRACT

What are claimed are synergistically active bleach mixtures consisting of
a) a compound of the formula (1)

(1)

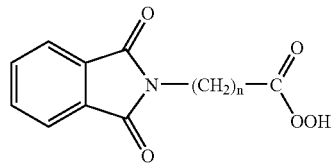

in which n is 3, 4 or 5, and
b) tetraacetylethylenediamine and/or 1,5-diacetyl-2,4-dioxo-1,3,5-hexa-hydrotriazine.

2 Claims, No Drawings

MIXTURES OF BLEACHING AGENTS

The invention relates to improved bleach mixtures for use in washing compositions, cleaning compositions and disinfectants. In particular, the invention relates to cogranules of such bleach mixtures with improved bleaching performance on a multitude of bleachable stains.

Inorganic peroxygen compounds, especially hydrogen peroxide and solid peroxygen compounds which dissolve with release of hydrogen peroxide in water, such as sodium perborate and sodium carbonate perhydrate, have been used for some time as oxidizing agents for disinfection and bleaching purposes. The oxidizing action of these substances in dilute solutions depends greatly on the temperature; for example, with $H_2O_2$ or perborate in alkaline bleaching liquors, sufficiently rapid bleaching of soiled textiles is achieved only at temperatures above about 80° C.

At lower temperatures, the oxidizing action of the inorganic peroxygen compounds can be improved by adding so-called bleach activators. For this purpose, numerous proposals have been developed in the past, in particular from the substance classes of the N- or O-acyl compounds, for example polyacylated alkylenediamines, especially tetraacetylethylene-diamine and tetraacetylglycoluril, N-acylated hydantoins, hydrazides, triazoles, hydrotriazines, urazoles, diketopiperazines, sulfurylamides and cyanurates, and also carboxylic anhydrides, especially phthalic anhydride and substituted maleic anhydrides, carboxylic esters, especially sodium acetoxybenzenesulfonate, sodium benzoyloxybenzenesulfonate (BOBS), sodium nonanoyloxybenzenesulfonate (NOBS), sodium isononanoyloxybenzenesulfonate (ISONOBS), and acylated sugar derivatives such as pentaacetylglucose. Addition of these substances allows the bleaching action of aqueous peroxide solutions to be enhanced to such an extent that essentially the same effects as with the peroxide solution alone at 95° C. occur even at temperatures of around 40-60° C.

Bleach activators are essentially constituents in pulverulent or tableted washing compositions, stain removal salts or machine dishwasher detergents, and they are used especially in granulated form. This improves their storage stability significantly. The achievable bleaching result is determined essentially by the water solubility of the activator, the structure of the compound to be perhydrolyzed, type and reactivity of the peracid formed, of the granulating assistant, and the type of granule preparation.

Bleach activators can be divided into two classes with regard to their reactivity toward particular stains, hydrophilic and hydrophobic. Hydrophilic bleach activators remove especially tea or red wine stains, while hydrophobic activators preferably decolorize oily discolorations such as ketchup and barbecue sauce. However, many stains which occur in daily life do not fall within these classes (for example grass, curry) or are mixtures of different types of stains (for example baby food). Here, the use of a single bleach activator usually leads to unsatisfactory results. With regard to further reduced washing temperatures and more volume-efficient formulations, synergistically active mixtures of washing composition ingredients will be of particular interest in the future.

The use of specific activator mixtures consisting of a hydrophilic activator and a hydrophobic activator is prior art. The hydrophobic components used are predominantly derivatives of the readily water-soluble sodium phenolsulfonate. For example, EP-A-0 257 700 claims mixtures of nonanoyloxybenzenesulfonate with tetraacetylethylenediamine, benzoyl-oxybenzenesulfonate or acetoxybenzenesulfonate. WO 02/083 829 describes improved effectiveness of mixtures consisting of tetraacetyl-ethylenediamine and sodium (4-sulfophenyloctyl)carbonate.

The bleaching optimum of the activator mixtures is dependent upon the type and mixing ratio of the activators used and upon the type of the stains to be removed and cannot, as experience has shown, be calculated theoretically in advance. There is therefore a great interest in new types of bleach activator mixtures with which synergistic effects can be achieved.

It has now been found that, surprisingly, mixtures of particular peracetic acid-releasing activators with hydrophobic organic peracids have significant synergistic effects on difficult-to-remove stains such as grass and curry.

The invention provides bleach mixtures consisting of a) a compound of the formula (1)

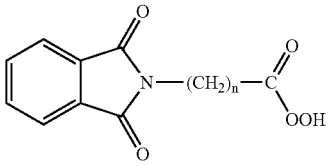

(1)

in which n is 3, 4 or 5, and b) tetraacetylethylenediamine and/or 1,5-diacetyl-2,4-dioxo-1,3,5-hexa-hydrotriazine.

A particularly preferred peracid of the formula (1) is phthalimidoperoxocaproic acid (PAP).

In a preferred use form, these activator mixtures are used in the form of cogranules as a bleach component together with a hydrogen peroxide-generating substance in washing compositions, cleaning compositions and disinfectants.

Corresponding phthalimidoperoxycarboxylic acids are described, for example, in EP-A-0 325 288, EP-A-0 325 289 and EP-A-0 349 940, tetraacetylethylenediamine in GB 907, 356, and 1,5-diacetyl-2,4-dioxo-1,3,5-hexahydrotriazine in DD 229 696 and DD 259 634.

In inventive bleach mixtures, the ratio of organic peracid to N-acyl compound is from 95:5 to 5:95% by weight, preferably from 75:25 to 25:75% by weight. In a particularly preferred embodiment, these mixtures are prepared in granulated form. Here, the use of additives and/or coating agents may be advantageous. In such granules, the proportion of the bleach mixtures is 5-98% by weight, preferably 40-95%; the remainder is accounted for by additives and/or coating agents.

In the inventive washing compositions, cleaning compositions and disinfectants, the bleach mixtures are used in combination with hydrogen peroxide or inorganic peroxy compounds. Useful compounds for this purpose are primarily all alkali metal perborates, preferably in the form of the mono- or tetrahydrates, and/or alkali metal percarbonates, sodium being the preferred alkali metal. The ratio of bleach mixture and peroxide compound is from 1:0.5 to 1:20 parts by weight, preferably from 1:1 to 1:5 parts by weight.

The bleach mixtures are used in the inventive washing compositions or if the cleaning compositions are machine dishwasher detergents in concentrations of 0.1-15% by weight, preferably 1-8% by weight. In stain removal salts or disinfectants, the proportion of the bleach activator mixture may also be up to 50%.

The term "bleaching" is understood here to mean both bleaching of soil present on the textile surface and the bleaching of soil which has been detached from the textile surface and is present in the wash liquor. For bleaching of stains present on hard surfaces, the same applies mutatis mutandis. Further potential uses are in the personal care sector, for example in the bleaching of hair and for improving the effectiveness of denture cleaners. In addition, the inventive activator mixtures find use in commercial laundries, in wood and paper bleaching, the bleaching of cotton and in disinfectants.

The invention further relates to a process for cleaning textiles and also hard surfaces, especially of dishware, using the bleach mixtures mentioned in combination with the peroxide compound in aqueous solution optionally comprising further washing or cleaning composition constituents, and to washing compositions and cleaning compositions for hard surfaces, especially cleaning compositions for dishware, preference being given to those for use in machine processes.

The bleach mixture can be formulated in different ways, and the state of matter of the active substance at the start of the formulation may be of crucial significance for the choice of process. The term "formulation" is understood here in particular to mean the granulation of the bleach mixture.

Bleach Mixtures as Solids:

When the mixture is present in solid form, different ways of formulation are available. Typically, in these processes, one or more additives which may have binding, stabilizing and/or supplementary function are added. The binder material is frequently added in liquid form, but may also be introduced as a solid which is activated in the granulating apparatus by an auxiliary liquid (usually water).

Buildup Granulation in Mixing Apparatus:

The mixer granulation of the components can be effected in customary batchwise or continuous mixing apparatus which are generally equipped with rotating mixer units. The mixers used may be moderate apparatus, for example plowshare mixers (Lödige K M types, Drais K-T types), but also intensive mixers (for example Eirich, Schugi, Lödige C B types, Drais K-TT types). In the mixing, all mixing variants which ensure sufficient mixing of the components are conceivable. In a preferred embodiment, all components are mixed simultaneously. However, multistage mixing processes in which the individual components are introduced into the overall mixture in different combinations, individually or together with other additives, are also conceivable. The sequence of slow and fast mixers can be switched as required. The residence times in the mixer granulation are preferably from 0.5 s to 20 min, more preferably from 2 s to 10 min. Depending on the granulating liquid used (solvent or binder in molten form), the granulation stage is followed by a drying (for solvent) or cooling step (for melts), in order to prevent adhesion of the granules. The aftertreatment preferably takes place in a fluidized bed apparatus. Subsequently, screening removes the coarse and the fine fraction. The coarse fraction is comminuted by grinding and, just like the fine fraction, fed to another granulation process.

Granulation with the Aid of a Plasticizer:

In a further preferred embodiment, the solid mixture is admixed with one or more plasticizing substances. Further solid and liquid additives are likewise possible. The plasticizing substances may be introduced in liquid (solid or usually water) or molten form. Depending on the plasticizing system, particularly careful temperature control (mixture with melt) or precise control of the moisture budget (mixture with solvent/water) should be ensured in the process in order to prevent an undesired change in the plasticity of the mixture (in particular decrease by cooling, solidification or drying).

The liquid plasticizer is mixed intensively with the pulverulent bleach mixture and, if appropriate, the further additives, so as to form a plastically deformable composition. The mixing step can be effected in the abovementioned mixing apparatus, but kneaders or specific extruder types (for example Extrud-o-mix from Hosokawa-Bepex Corp.) are also conceivable. The granulating composition is subsequently pressed by means of tools through the die bores of a compression die, so as to form cylindrically shaped extrudates. Suitable apparatus for the extrusion process is edgerunner presses (for example from Schlüter), pan mills (for example from Amandus-Kahl) and extruders, designed as a single-shaft machine (for example from Hosokawa-Bepex, Fuji-Paudal), or preferably as twin-screw extruders (for example from Händle). The selection of the diameter of the die bore is dependent upon the individual case and is typically in the range of 0.7-4 mm.

The emerging extrudates should be comminuted to the desired length or particle size by an aftertreatment step. In many cases, a length/diameter ratio of L/D=1 is desired. In cylindrical granules, the particle diameter is between 0.2 mm and 2 mm, preferably between 0.5 mm and 0.8 mm, the particle length in the range from 0.5 mm to 3.5 mm, ideally between 0.9 mm and 2.5 mm. The length and size adjustment of the granules can be effected, for example, by means of fixed stripper blades, rotating cutting blades, cutting wires or blades. To round off the cut edges, the granule can then be rounded once again in a rounder (for example from Glatt, Schlüter, Fuji-Paudal).

In another preferred embodiment, the extrudate is initially crushed only coarsely and the extrudates are transferred directly into a rounder. The further granule shaping (cylindrical to spherical particles are possible) is effected in the rounding step; in a preferred embodiment, the process is performed in cascade operation. Size and shape of the particles can be influenced and brought about in the rounding process by means of several parameters. The shaping process is determined by the fill level, the temperature of the mixture, the residence time of the mixture in the rounder, by the speed of the rounding disk, and by the plastic deformability of the mixture. With decreasing fill level in the rounder, shorter cylinder granules and a narrower distribution of the particle sizes are obtained. With decreasing plasticity, longer granules are initially obtained; in the event of a further decrease in the plasticity, the dust fraction increases greatly and controlled particle shaping can no longer be achieved.

After the size adjustment of the granules, a final consolidation step is required, in which the solvent is removed or the melt is solidified. Typically, this step is performed in a fluidized bed apparatus which, according to the requirements, is operated as a dryer or cooler. Subsequently, screening removes the coarse and the fine fractions. The coarse fraction is comminuted by grinding and, just like the fine fraction, fed to another granulation process.

Compaction

In a further preferred embodiment, the pulverulent bleach mixture is optionally mixed with further, preferably solid additives and this mixture is compacted, then ground and then optionally screened into individual particle fractions. Optionally, it is also possible for liquid additives additionally to be added to the mixture to a certain degree (for example up to 10%). Examples of compacting assistants are waterglass, polyethylene glycols, nonionic surfactants, anionic surfactants, polycarboxylate copolymers, modified and/or unmodified celluloses, bentonites, hectorites, saponites and/or other washing composition ingredients.

The compaction is preferably performed on so-called roll compacters (for example from Hosokawa-Bepex, Alexanderwerk, Köppern). The selection of the roller profile allows, firstly, pellets or briquettes, and, secondly, pressed slugs to be obtained. While the pressings in piece form typically only have to be removed from the fines, the slugs have to be ground to the desired particle size in a mill. Typically, the mill types used are preferably gentle milling apparatus, for example screening and hammer mills (for example from Hosokawa-Alpine, Hosokawa-Bepex) or roll mills (for example from Bauermeister, Bühler).

The fine fraction and, if appropriate, the coarse fraction are removed by screening from the granule thus obtained. The coarse fraction is fed back to the mill; the fine fraction is fed back to the compaction. For classification of the granules, it is possible, for example, to use screening machines from Allgaier, Sweco, Rhewum.

Bleach Mixture as Solutions or Suspensions:

When the bleach mixture is in the form of a solution or suspension, possible methods for formulation are in particular spray-drying and fluidized bed granulation. Spray-drying typically achieves a spray powder with a particle size of <200 μm, and this powder can subsequently be processed in a further formulation step to give larger particles. In a preferred embodiment, the liquid that contains the bleach mixture is converted directly to a granule in a fluidized bed granulation process. According to the processing properties of the activator mixture and the desired granule formulation, the spray liquid may comprise one or more added additives which may be mixed in either in liquid or solid form. In addition to a binder function, the additives may also have the task of stabilization or of a supplementary component to the actual active substance. Especially in the case of admixing of solid additives, an optimal preparation of the spray slurry for the spray process is advantageous, for example a milling step for comminuting solid particles, for which it is frequently possible to use toothed-disk colloid mills. For the controlled adjustment of the viscosity of the spray liquid, a dilution and/or heat treatment can be undertaken.

In another preferred embodiment, one or more additives can be metered into the process in solid form separately. It is also possible for the dust fractions of finished granule, as are typically obtained, to be recycled as solid into the fluidized bed. This recycling of the dust fractions is possible in principle in all process variants for granulation. The separate metering of solids allows, for example, the controlled feeding of a carrier material for the introduction of tacky active substances. In addition, the separate solid feeding can be found to be a useful control instrument for granule growth in the process.

The fluidized bed processes described can be performed in apparatus which are designed either with round or with rectangular geometries.

In the case of the particularly preferred peracid PAP, particular attention should be paid to the safety aspect in the selection of a suitable granulation process. In addition to the flammable properties, the limited thermal stability should also be taken into account, such that processes with potentially increased energy input (mechanical, for example compaction, and thermal, for example, spray-drying) should be considered and evaluated as a special case under this aspect. In contrast, it may be found that more advantageous processes are those in which the selection of the process conditions and/or of the auxiliaries enable improved control of the energy input. With regard to the auxiliaries, additions of inert materials, such as inorganic salts (e.g. sodium sulfate) can have a positive effect on the phlegmatization of the peracid.

Additives:

As mentioned repeatedly, it is necessary in many cases to add one or more additives in the granulation process. Specifically, these additives may have the following function.

Solid Carriers:

Suitable carrier materials are, for example, silicates, clays, carbonates, phosphates, sulfates and citrates. Clays are naturally occurring crystalline or amorphous silicates of aluminum, of iron, of magnesium, of calcium, of potassium and of sodium, for example kaolin, talc, pyrophyllite, attapulgite, sepiolite, saponites, hectorites, smectites such as montmorillonite, especially bentonites, bauxite and zeolites. Particularly suitable crystalline sheet-type alkali metal silicates are those of the formula $MM'Si_xO_{(2x-1)}*yH_2O$ (M,M'=Na, K, H, x=1.9-23; y=0-25), preferably sodium silicates, for example types obtainable under the trade names SKS-6 and Nabion 15.

Likewise suitable are type A and P zeolites, and also bentonites as are commercially available under the name Laundrosil® DGA, Laundrosil® EX 0242 or Ikomont® CA weiβ. Sheet silicates may also be used in acid-modified form, as available in the commercial products Tonsil® EX 519, Tonsil Optimum 210 FF, Tonsil Standard 310 FF and 314 FF, and Opazil® SO from Südchemie.

Further suitable carrier materials are alkali metal phosphates, which may be present in the form of their alkaline, neutral or acidic sodium or potassium salts. Examples thereof are trisodium phosphate, tetrasodium diphosphate, disodium dihydrogendiphosphate, pentasodium triphosphate, so-called sodium hexametaphosphate, oligomeric trisodium phosphate having degrees of oligomerization of from 5 to 1000, in particular from 5 to 50, and mixtures of sodium and potassium salts.

Usable organic carrier materials are, for example, the carboxylic acids which are preferably used in the form of their sodium salts, such as citric acid and nitriloacetate (NTA), ethylenediaminetetraacetic acid. It is also possible to use polymeric carboxylates and their salts in an analogous manner. These include, for example, the salts of homopolymeric or copolymeric polyacrylates, polymethacrylates, and especially copolymers of acrylic acid with maleic acid, preferably those composed of from 50 to 10% maleic acid, polyaspartic acid, and also polyvinylpyrrolidone and urethanes. The relative molecular mass of the homopolymers is generally between 1000 and 100 000, that of the copolymers between 2000 and 200 000, preferably from 50 000 to 120 000, based on the free acid. In particular, water-soluble polyacrylates which have been crosslinked, for example, with about 1% of a polyallyl ether of sucrose and which have a relative molecular mass of above one million are also suitable. Examples thereof are the polymers obtainable under the name Carbopol 940 and 941.

Binders:

Useful binders include cellulose and starch and their ethers or esters, for example carboxymethylcellulose (CMC), methylcellulose (MC) or hydroxyl-ethylcellulose (HEC) and the corresponding starch derivatives, but also film-forming polymers, for example polyacrylic acids and copolymers of maleic anhydride and acrylic acid, and also the salts of these polymeric acids. Commercial products are, for example, Sokalan® CP 5 or 45, Sokalan CP 12 S or CP 13 S.

The binders and granulating assistants used may also be surfactants, especially anionic and nonionic surfactants, surfactant compounds, di- and polysaccharides, cyclodextrins, meltable polyesters, polyalkylene glycols, especially polyethylene glycols, polypropylene glycols, more preferably polyethylene glycols having molecular weights of from 1000 to 10 000, preferably from 3000 to 6000, more preferably 4000, fatty acids, especially saturated fatty acids such as lauric acid, myristic acid, palmitic acid, stearic acid, hydrogenated erucic acid and behenic acid, and also mixtures derived in particular from natural fatty acids, for example coconut, palm kernel or tallow fatty acids, soaps, especially saturated fatty acid soaps, and waxes.

Preferred anionic surfactants are alkali metal salts, ammonium salts, amine salts and salts of amino alcohols of the following compounds: alkyl sulfates, alkyl ether sulfates, alkylamide sulfates and ether sulfates, alkylaryl polyether sulfates, monoglyceride sulfates, alkanesulfonates, (α-olefin-sulfonates, alkylarylsulfonates, arylsulfonates, especially cumene-, xylene-, toluenesulfonate, alkylamide sulfonates, alkyl sulfosuccinates, alkyl ether sulfosuccinates, alkylamide sulfosuccinates, alkyl sulfoacetates, alkyl-polyglyceryl carboxylates, alkyl phosphates, alkyl ether phosphates, alkyl sarcosinates, alkyl polypeptidates, alkylamido polypeptidates, alkyl isothionates, alkyl taurates, alkyl polyglycol ether carboxylic acids or fatty acids, such as oleic acid, ricinoleic acid, palmitic acid, stearic acid, copra oil acid salt or hydrogenated copra oil acid salts. The alkyl radical of all of these compounds normally contains 8-32, preferably 8-22 carbon atoms.

Useful nonionic surfactants include polyethoxylated, polypropoxylated and polyglycerylated fatty acid alkyl esters, polyethoxylated esters of fatty acids and of sorbitol, polyethoxylated or polyhydroxy fatty acid amides of the formula $R_2$—CO—N($R_3$)-Z in which $R_2$CO is an aliphatic acyl radical having from 6 to 22 carbon atoms, $R_3$ is hydrogen, an alkyl or hyroxyalkyl radical having from 1 to 4 carbon atoms, and Z is a linear or branched polyhydroxyalkyl radical having from 3 to 10 carbon atoms and from 3 to 10 hydroxyl groups, but also alkyl glycosides of the general formula $RO(G)_x$ where R is a primary straight-chain or methyl-branched, especially 2-methyl-branched, aliphatic radical having from 8 to 22, preferably from 12 to 18 carbon atoms, and G is a glycose unit having 5 or 6 carbon atoms, preferably glucose. The degree of oligomerization x, which specifies the distribution of monoglycosides and oligoglycosides, is preferably from 1 to 10; x is more preferably from 1.2 to 1.4.

Acidic Additives:

Suitable acidic additives are sulfuric acid, sodium hydrogensulfate, phosphoric acid, sodium hydrogenphosphate, phosphonic acids and their salts, carboxylic acids or their salts, for example citric acid in anhydrous or hydrated form, glycolic acid, succinic acid, succinic anhydride, glutaric acid, glutaric anhydride, adipic acid, adipic anhydride, maleic acid, maleic anhydride or lactic acid, but also acidic polymers. Particularly suitable acidic additives are polyacrylic acid, polymaleic acid or copolymers of acrylic acid and maleic acid (Sokalan® types).

Coating:

The granules obtained in accordance with the invention are suitable directly for use in washing and cleaning compositions. In a particularly preferred use form, they can, however, be provided with a coating by processes known per se. For this purpose, the granule is enveloped with a film-forming substance in an additional step, which can considerably influence the product properties.

Suitable coating agents are all film-forming substances, such as waxes, silicones, fatty acids, fatty alcohols, soaps, anionic surfactants, nonionic surfactants, cationic surfactants, anionic and cationic polymers, and polyalkylene glycols. Preference is given to using coating substances having a melting point of 30-100° C. Examples thereof are $C_8$-$C_{31}$ fatty acids, for example lauric acid, myristic acid, stearic acid); C8-$C_{31}$ fatty alcohols; polyethylene glycols having a molar mass of from 1000 to 50 000 g/mol; fatty alcohol polyalkoxylates with from 1 to 100 moles of EO; alkanesulfonates, alkylbenzenesulfonates, α-olefinsulfonates, alkyl sulfates, alkyl ether sulfates having $C_8$-$C_{31}$ hydrocarbon radicals, polymers, for example polyvinyl alcohols, waxes, for example montan waxes, paraffin waxes, ester waxes, polyolefin waxes, silicones.

It is additionally possible for substances which do not soften or melt in the range from 30 to 100° C. to be present in dissolved or suspended form in the coating substance which does soften or melt in this range, for example homopolymers, copolymers or graft copolymers of unsaturated carboxylic acids and/or sulfonic acids and their alkali metal salts, cellulose ethers, starch, starch ethers, polyvinylpyrrolidone; mono- and polybasic carboxylic acids, hydroxycarboxylic acids or ethercarboxylic acids having from 3 to 8 carbon atoms and their salts; silicates, carbonates, bicarbonates, sulfates, phosphates, phosphonates.

Depending on the desired properties of the coated granule, the proportion of envelope substance may be from 1 to 30% by weight, preferably from 5 to 15% by weight, based on the coated granule.

For the application of the envelope substances, it is possible to use mixers (mechanically induced fluidized bed) and fluidized bed apparatus (pneumatically induced fluidized bed). Possible mixers are, for example, plowshare mixers (continuous and batchwise), ring layer mixers or else Schugi mixers. When a mixer is used, the heat treatment can be effected in a granule preheater and/or directly in the mixer and/or in a fluidized bed downstream of the mixer. To cool the coated granule, granule coolers or fluidized bed coolers can be used. In the case of fluidized bed apparatus, the heat treatment is effected by means of the hot gas used for the fluidization. The granule coated by the fluidized bed process can be cooled by means of a granule cooler or a fluidized bed cooler similarly to the case of the mixing process. Both in the mixing process and in the fluidized bed process, the coating substance can be sprayed on by means of a one-substance or a two-substance nozzle apparatus. The optional heat treatment consists in heat treatment at a temperature of from 30 to 100° C., but equal to or below the melting or softening temperature of the particular envelope substance. Preference is given to working at a temperature which is just below the melting or softening temperature.

The inventive bleach mixtures can be used in washing compositions, cleaning compositions and disinfectants together with hydrogen peroxide or inorganic peroxy compounds. Essential components of such washing compositions, cleaning compositions and disinfectants will be detailed below.

Surface-active Substances

Anionic Surfactants

The washing and cleaning compositions may comprise one or more surfactants, and useful surfactants are in particular anionic surfactants, nonionic surfactants and mixtures thereof, but also cationic, zwitterionic and amphoteric surfactants. Such surfactants are present in the inventive washing compositions in proportions of preferably from 1% by weight to 50% by weight, in particular from 3% by weight to 30% by weight, whereas cleaning compositions for hard surfaces normally contain smaller proportions, i.e. amounts of up to 20% by weight, in particular of up to 10% by weight and preferably in the range from 0.5% by weight to 5% by weight. Cleaning compositions for use in machine dishwashing processes are normally low-foaming compounds.

Suitable anionic surfactants are in particular soaps and those which contain sulfate or sulfonate groups. Useful surfactants of the sulfonate type are preferably $C_9$-$C_{13}$-alkylbenzenesulfonates, olefinsulfonates, i.e. mixtures of alkene- and hydroxyalkanesulfonates, and also disulfonates, as are obtained, for example, from monoolefins having terminal or internal double bonds by sulfonating with gaseous sulfur trioxide and subsequent alkaline or acidic hydrolysis of the sulfonation products. Also suitable are alkanesulfonates which are obtained from $C_{12}$-$C_{18}$-alkanes, for example by sulfochlorination or sulfoxidation with subsequent hydrolysis and neutralization respectively. Also suitable are the esters of alpha-sulfo fatty acids (ester sulfonates) for example the alpha-sulfonated methyl esters of hydrogenated coconut, palm kernel or tallow fat acids, which are prepared by sulfonating the methyl esters of fatty acids of vegetable and/or animal origin having from 8 to 20 carbon atoms in the fatty acid molecule and subsequent neutralization to give water-soluble monosalts.

Further suitable anionic surfactants are sulfated fatty acid glycerol esters which are mono-, di- and triesters, and mixtures thereof. Preferred alk(en)yl sulfates are the alkali metal and in particular the sodium salts of the sulfuric monoesters of the. $C_{12}$-$C_{18}$-fatty alcohols, for example of coconut fatty alcohol, tallow fatty alcohol, lauryl, myristyl, cetyl or stearyl alcohol, or of the $C_8$-$C_{20}$-oxo alcohols and those monoesters of secondary alcohols of this chain length. Also preferred are alk(en)yl sulfates of the chain length mentioned which contain a synthetic, straight-chain alkyl radical prepared on a petrochemical basis. 2,3-Alkyl sulfates, which are prepared, for example, according to U.S. Pat. Nos. 3,234,158 and 5,075,041, are also suitable anionic surfactants. Also suitable are the sulfuric monoesters of the straight-chain or branched alcohols ethoxylated with from 1 to 6 mol of ethylene oxide, such as 2-methyl-branched $C_9$-$C_{11}$-alcohols with on average 3.5 mol of ethylene oxide (EO) or $C_{12}$-$C_{18}$ fatty alcohols having from 1 to 4 EO.

The preferred anionic surfactants also include the salts of alkylsulfosuccinic acid which are also referred to as sulfosuccinates or as sulfosuccinic esters, and the mono- and/or diesters of sulfosuccinic acid with alcohols, preferably with fatty alcohols and in particular with ethoxylated fatty alcohols. Preferred sulfosuccinates contain C8-$C_{18}$ fatty alcohol radicals or mixtures of these. Useful further anionic surfactants include fatty acid derivatives of amino acids, for example of N-methyltaurine (taurides) and/or of N-methylglycine (sarcosinates). Useful further anionic surfactants include in particular soaps, for example in amounts of from 0.2 to 5% by weight. Especially suitable are saturated fatty acid soaps, such as the salts of lauric acid, myristic acid, palmitic acid, stearic acid, hydrogenated erucic acid and behenic acid, and also in particular soap mixtures derived from natural fatty acids, for example coconut, palm kernel or tallow fat acids.

The anionic surfactants, including the soaps, may be present in the form of their sodium, potassium or ammonium salts, and as soluble salts of organic bases, such as mono-, di- or triethanolamine. The anionic surfactants are preferably present in the form of their sodium or potassium salts, in particular in the form of the sodium salts. Anionic surfactants are present in inventive washing compositions preferably in amounts of from 0.5 to 10% by weight and in particular in amounts of from 5 to 25% by weight.

Nonionic Surfactants

The nonionic surfactants used are preferably alkoxylated, advantageously ethoxylated, in particular primary alcohols having preferably from 8 to 18 carbon atoms and on average from 1 to 12 mol of ethylene oxide (EO) per mole of alcohol, in which the alcohol radical may be linear or preferably 2-methyl-branched, or may contain linear and methyl-branched radicals in a mixture, as are typically present in oxoalcohol radicals. However, especially preferred are alcohol ethoxylates having linear radicals from alcohols of native origin having from 12 to 18 carbon atoms, for example from coconut, palm, tallow fat or oleyl alcohol, and on average from 2 to 8 EO per mole of alcohol. Preferred ethoxylated alcohols include, for example, $C_{12}$-$C_{14}$-alcohols having 3 EO or 4 EO, $C_9$-$C_{11}$-alcohols having 7 EO, $C_{13}$-$C_{15}$-alcohols having 3 EO, 5 EO, 7 EO or 8 EO, $C_{12}$-$C_{18}$-alcohols having 3 EO, 5 EO or 7 EO and mixtures of these, such as mixtures of $C_{12}$-$C_{14}$-alcohol having 3 EO and $C_{12}$-$C_{18}$-alcohol having 7 EO. The degrees of ethoxylation specified constitute statistical averages which may be an integer or a fraction for a specific product. Preferred alcohol ethoxylates have a narrow homolog distribution (narrow range ethoxylates, NRE). In addition to these nonionic surfactants, fatty alcohols having more than 12 EO may also be used. Examples thereof are (tallow) fatty alcohols having 14 EO, 16 EO, 20 EO, 25 EO, 30 EO or40 EO.

The nonionic surfactants also include alkylglycosides of the general formula $RO(G)_x$ are used, in which R is a primary, straight-chain or methyl-branched, in particular 2-methyl-branched, aliphatic radical having from 8 to 22, preferably from 12 to 18, carbon atoms, and G is a glycose unit having 5 or 6 carbon atoms, preferably glucose. The degree of oligomerization x which specifies the distribution of monoglycosides and oligoglycosides is an arbitrary number, which may also assume fractional values as a quantity to be determined analytically, between 1 and 10; x is preferably from 1.2 to 1.4. Likewise suitable are polyhydroxy fatty acid amides of the formula (I) in which the $R^1CO$ radical is an aliphatic acyl radical having from 6 to 22 carbon atoms, $R^2$ is hydrogen, an alkyl or hydroxyalkyl radical having from 1 to 4 carbon atoms and [Z] is a linear or branched polyhydroxyalkyl radical having from 3 to 10 carbon atoms and from 3 to 10 hydroxyl groups.

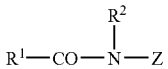

(I)

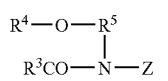

(II)

The polyhydroxy fatty acid amides preferably derive from reducing sugars having 5 or 6 carbon atoms, in particular from glucose. The group of the polyhydroxy fatty acid amides also includes compounds of the formula (II) $R^3$ is a linear or branched alkyl or alkenyl radical having from 7 to 12 carbon atoms, $R^4$ is a linear, branched or cyclic alkylene radical or an arylene radical having from 2 to 8 carbon atoms and $R^5$ is a linear, branched or cyclic alkyl radical or an aryl radical, or an oxyalkyl radical having from 1 to 8 carbon atoms, preference being given to $C_1$-$C_4$-alkyl or phenyl radicals, and [Z] is a linear polyhydroxyalkyl radical whose alkyl chain is substituted by at least two hydroxyl groups, or alkoxylated, preferably ethoxylated or propoxylated, derivatives of this radical.

[Z] is obtained here too preferably by reductive amination of a sugar such as glucose, fructose, maltose, lactose, galactose, mannose or xylose. The N-alkoxy or N-aryloxy-substituted compounds may then be converted to the desired polyhydroxy fatty acid amides by reacting with fatty acid methyl esters in the presence of an alkoxide as a catalyst.

A further class of nonionic surfactants used with preference, which may be used either as the sole nonionic surfactant or in combination with other nonionic surfactants, especially together with alkoxylated fatty alcohols and/or alkylglycosides, is that of alkoxylated, preferably ethoxylated or ethoxylated and propoxylated, fatty acid alkyl esters, preferably having from 1 to 4 carbon atoms in the alkyl chain, in particular fatty acid methyl esters.

Nonionic surfactants of the amine oxide type, for example N-cocoalkyl-N,N-dimethylamine oxide and N-tallowalkyl-N,N-dihydroxyethylamine oxide and of the fatty acid alkanolamides may also be suitable.

Useful further surfactants are what are known as gemini surfactants. This generally refers to those compounds which have two hydrophilic groups per molecule. These groups are generally separated from one another by a "spacer". This spacer is generally a carbon chain which should be long enough that the hydrophilic groups have a sufficient separation and they can act independently of one another. Such surfactants generally feature an unusually low critical micelle concentration and the ability to greatly reduce the surface tension of water. However, it is also possible to use gemini polyhydroxy fatty acid amides or poly-polyhydroxy fatty acid amides, as described in the international patent applications WO 95/19953, WO 95/19954 and WO 95/19955. Further surfactant types may have dendrimeric structures.

Builders

Inorganic Builders

An inventive washing composition preferably comprises at least one water-soluble and/or water-insoluble, organic and/or inorganic builder.

Useful water-soluble inorganic builder materials are in particular alkali metal silicates and polymeric alkali metal phosphates, which may be present in the form of their alkaline, neutral or acidic, sodium or potassium salts. Examples thereof are trisodium phosphate, tetrasodium diphosphate, disodium dihydrogendiphosphate, pentasodium triphosphate, what is known as sodium hexametaphosphate, and the corresponding potassium salts, or mixtures of sodium and potassium salts. The water-insoluble, water-dispersible inorganic builder materials used are in particular crystalline or amorphous alkali metal aluminosilicates, in amounts of up to 50% by weight. Among these, preference is given to the crystalline sodium aluminosilicates in detergent quality, in particular zeolite A, P and optionally X, alone or in mixtures, for example in the form of a cocrystal or zeolites A and X. Their calcium binding capacity is generally in the range from 100 to 200 mg of CaO per gram. Suitable builder substances are also crystalline alkali metal silicates which may be used alone or in a mixture with amorphous silicates. The alkali metal silicates which can be used as builders preferably have a molar ratio of alkali metal oxide to $SiO_2$ below 0.95, in particular from 1:1.1 to 1:12, and may be present in amorphous or crystalline form. Preferred alkali metal silicates are the sodium silicates, in particular the amorphous sodium silicates having a molar $Na_2O$:SiO ratio of from 1:2 to 1:2.8. The crystalline silicates which may be present alone or in a mixture with amorphous silicates are preferably crystalline sheet silicates of the general formula $Na_2Si_xO_{2x+1}\cdot Y\ H_2O$ in which x, known as the modulus, is from 1.9 to 4, and y is from 0 to 20, and preferred values of x are 2, 3 or 4. Preferred crystalline sheet silicates are those in which x in the general formula specified assumes the values of 2 or 3. Preference is given in particular to both β- and β-sodium disilicate ($Na_2Si_2O_5\cdot y\ H_2O$). It is also possible to use virtually anhydrous, crystalline alkali metal silicates, prepared from amorphous silicates, of the abovementioned general formula, in which x is a number from 1.9 to 2.1. In a further preferred embodiment of such compositions, a crystalline sodium sheet silicate having a modulus of from 2 to 3 is used, as can be prepared from sand and soda. Crystalline sodium silicates having a modulus in the range from 1.9 to 3.5 are used in a further preferred embodiment of inventive compositions. In a preferred embodiment of inventive compositions, a granular compound of alkali metal silicate and alkali metal carbonate is used, as obtainable, for example, under the Nabion® name. If alkali metal aluminosilicate, in particular zeolite, is also present as an additional builder substance, the weight ratio of aluminosilicate to silicate, based in each case on anhydrous active substances, is preferably from 1:10 to 10:1. In compositions which comprise both amorphous and crystalline alkali metal silicates, the weight ratio of amorphous alkali metal silicate to crystalline alkali metal silicate is preferably from 1:2 to 2:1 and in particular from 1:1 to 2:1.

Such builder substances are present in inventive compositions preferably in amounts of up to 60% by weight, in particular from 5 to 40% by weight.

Organic Builders

The water-soluble organic builder substances include polycarboxylic acids, especially citric acid and sugar acids, aminopolycarboxylic acids, especially methylglycinediacetic acid, nitrilotriacetic acid and ethylenediaminetetra-acetic acid, and also polyaspartic acid.

Polyphosphonic acids, especially aminotris(methylenephosphonic acid), ethylenediaminetetrakis(methylenephosphonic acid) and 1-hydroxyethane-1,1-diphosphonic acid may likewise be used. Preference is also given to polymeric (poly)carboxylic acids, especially the polycarboxylates obtainable by oxidation of polysaccharides and dextrins, polymeric acrylic acids, methacrylic acids, maleic acids and copolymers of these which may also contain small fractions of polymerizable substances without carboxylic acid functionality in copolymerized form. The relative molecular mass of the homopolymers of unsaturated carboxylic acids is generally between 5000 and 200 000, that of the copolymers between 2000 and 200 000, preferably from 50 000 to 120 000, based in each case on free acid. A particularly preferred acrylic acid-maleic acid copolymer has a relative molecular mass of from 50 000 to 100 000. Commercial products are, for example, Sokalan® CP 5, CP 10 and PA 30 from BASF. Also suitable are copolymers of acrylic acid or methacrylic acid with vinyl ethers, such as vinyl methyl ethers, vinyl esters, ethylene, propylene and styrene, in which the proportion of the acid is at least 50% by weight. The water-soluble organic builder substances used may also be terpolymers which contain, as monomers, two unsaturated acids and/or salts thereof and, as a third monomer, vinyl alcohol and/or an esterified vinyl alcohol or a carbohydrate. The first acidic monomer or salt thereof derives from a monoethylenically unsaturated C3-C8-carboxylic acid and preferably from a C3-C4-monocarboxylic acid, especially from (meth)acrylic acid.

The second acidic monomer or the salt thereof may be a derivative of a $C_4$-$C_8$-dicarboxylic acid, particular preference being given to maleic acid, and/or a derivative of an allysulfonic acid which is substituted in the 2-position by an alkyl or aryl radical. Such polymers generally have a relative molecular mass between 1000 and 200 000. Further preferred copolymers are those which preferably have as monomers acrolein and acrylic acid/acrylic acid salts or vinyl acetate.

Especially for the preparation of liquid compositions, the organic builder substances may be used in the form of aqueous solutions, preferably in the form of from 30 to 50% by weight aqueous solutions. All of the acids mentioned are generally used in the form of their water-soluble salts, especially their alkali metal salts.

Such organic builder substances may, if desired, be present in amounts of up to 40% by weight, in particular up to 25% by weight, and preferably from 1 to 8% by weight. Amounts close to the upper limit mentioned are used preferably in pasty or liquid, especially aqueous compositions.

Useful water-soluble builder components in inventive cleaning compositions for hard surfaces are in principle all builders used customarily in compositions for the machine cleaning of dishes, for example the abovementioned alkali metal phosphates. Their amounts may be in the range of up to about 60% by weight, in particular from 5 to 20% by weight, based on the overall composition. Further possible water-soluble builder components, in addition to polyphosphonates and phosphonate alkyl carboxylates, are, for example, organic polymers of native or synthetic origin of the above-detailed type of the polycarboxylates which function as cobuilders especially in hard water regions, and naturally occurring hydroxycarboxylic acids, for example mono-, dihydroxysuccinic acid, alpha-hydroxypropionic acid and gluconic acid. The organic builder components used with preference include the salts of citric acid, especially sodium citrate. The sodium citrate used is anhydrous trisodium citrate and preferably trisodium citrate dihydrate. Trisodium citrate dihydrate may be used in the form of finely or coarsely crystalline powder. Depending upon the pH set ultimately in the inventive cleaning compositions, the acids corresponding to the cobuilder salts mentioned may also be present.

Enzymes

The enzymes optionally present in the inventive compositions include proteases, amylases, pullulanases, cellulases, cutinases and/or lipases, for example proteases such as BLAP®, Optimase®, Opticlean®, Maxacal®, Maxapem®, Durazym®, Purafect®, OxP, Esperase® and/or Savinase®, amylases such as Termamy®, Amylase-LT, Maxamyl®, Duramyl®, Purafectel OxAm, cellulases such as Celluzyme®, Carezyme®, K-AC® and/or lipases, such as Lipolase®, Lipomax®, Lumafast® and/or Lipozym®. The enzymes used may be adsorbed on carriers and/or embedded in envelope substances in order to protect them from premature inactivation. They are present in inventive washing and cleaning compositions preferably in amounts of up to 10% by weight, in particular from 0.05 to 5% by weight, particular preference being given to the use of enzymes stabilized against oxidative degradation.

Inventive machine dishwasher detergents preferably comprise the customary alkali carriers, for example alkali metal silicates, alkali metal carbonates and/or alkali metal hydrogencarbonates. The customarily used alkali carriers include carbonates, hydrogencarbonates and alkali metal silicates having a molar $SiO_2/M_2O$ ratio (M=alkali metal atom) of from 1:1 to 2.5:1. Alkali metal silicates may be present in amounts of up to 40% by weight, in particular from 3 to 30% by weight, based on the overall composition. The alkali carrier system used with preference in the inventive cleaning compositions is a mixture of carbonate and hydrogencarbonate, preferably sodium carbonate and hydrogencarbonate which may be present in an amount of up to 50% by weight, preferably from 5 to 40% by weight.

In a further embodiment of inventive compositions for the automatic washing of dishes, from 20 to 60% by weight of water-soluble organic builders, in particular alkali metal citrate, from 3 to 20% by weight of alkali metal carbonate and from 3 to 40% by weight of alkali metal disilicate are present.

In order to bring about silver corrosion protection, it is possible to use silver corrosion inhibitors in inventive cleaning compositions for dishes. Preferred silver corrosion protectants are organic sulfides such as cystine and cysteine, di- or trihydric phenols, optionally alkyl- or aryl-substituted triazoles such as benzotriazole, isocyanuric acid, salts and/or complexes of titanium, zirconium, hafnium, molybdenum, vanadium or cerium, and salts and/or complexes of the metals present in complexes suitable in accordance with the invention with ligands other than those specified in formula (I).

When the compositions foam too vigorously on use, it is possible also to add to them up to 6% by weight, preferably from about 0.5 to 4% by weight, of a foam-regulating compound, preferably from the group comprising silicones, paraffins, paraffin-alcohol combinations, hydrophobicized silicas, fatty acid bisamides and mixtures thereof, and other known commercially available foam inhibitors. The foam inhibitors, especially silicone- and/or paraffin-containing foam inhibitors, are preferably bound to a granular carrier substance soluble or dispersible in water. Special preference is given to mixtures of paraffins and bistearylethylenediamide. Further optional ingredients in the inventive compositions are, for example, perfume oils.

The organic solvents which can be used in the inventive compositions, especially when they are present in liquid or pasty form, include alcohols having from 1 to 4 carbon atoms, in particular methanol, ethanol, isopropanol and tert-butanol, diols having from 2 to 4 carbon atoms, especially ethylene glycol and propylene glycol, and mixtures thereof and the ethers derivable from the compound classes mentioned. Such water-miscible solvents are present in the inventive cleaning compositions preferably to an extent of not more than 20% by weight, in particular from 1 to 15% by weight.

To set a desired pH which does not arise automatically by the mixing of the remaining components, the inventive compositions may comprise system- and environment-compatible acids, especially citric acid, acetic acid, tartaric acid, malic acid, lactic acid, glycolic acid, succinic acid, glutaric acid and/or adipic acid, but also mineral acids, especially sulfuric acid or alkali metal hydrogensulfates, or bases, especially ammonium or alkali metal hydroxides. Such pH regulators are present in the inventive compositions preferably to the extent of not more than 10% by weight, in particular from 0.5 to 6% by weight.

The inventive compositions are preferably in the form of pulverulent, granular or tableted preparations which can be produced in a known manner, for example by mixing, granulating, roll-compacting and/or by spray-drying the thermally stressable components, and mixing in the more sensitive components, which include in particular enzymes, bleaches and the bleach catalyst. Inventive compositions in the form of aqueous solutions or those comprising other customary solvents are particularly advantageously prepared by simply mixing the ingredients which can be introduced in substance or as a solution into an automatic mixer.

To produce particulate compositions with increased bulk density, especially in the range from 650 g/l to 950 g/l, preference is given to a process which has an extrusion step and is disclosed by the European patent EP 0 486 592. A further preferred production method with the aid of a granulation process is described in the European patent EP 0642 576.

Inventive compositions in the form of nondusting, storage-stably free-flowing powders and/or granules having high bulk densities in the range from 800 to 1000 g/l can also be prepared by mixing, in a first process stage, the builder components with at least a portion of liquid mixture components while increasing the bulk density of this premixture, and subsequently, if desired after an intermediate drying, combining the further constituents of the composition, including the bleach catalyst, with the thus obtained premixture.

To prepare the inventive compositions in tablet form, the procedure is preferably to mix all constituents with one another in a mixer and to compress the mixture by means of conventional tablet presses, for example eccentric presses or rotary presses, with compression pressures in the range from $200 \cdot 10^5$ Pa to $1500 \cdot 10^5$ Pa. In this way, tablets which are fracture-resistant and nevertheless sufficiently rapidly soluble under use conditions and have flexural strengths of normally above 150 N are obtained without any problem. A tablet prepared in this way preferably has a weight of from 1-5 g to 40 g, in particular from 20 g to 30 g, at a diameter of from 3-5 mm to 40 mm.

EXAMPLES

Example 1

Bleaching Performance of phthalimidoperoxycaproic acid (PAP) in Combination with tetraacetylethylenediamine (TAED)

The bleaching performance of the individual activators and of the inventive mixtures was investigated in a Linitest unit (from Heraus) at 20° C. To this end, 5 g/l of a bleach-free base washing composition (WMP, WFK, Krefeld) and 0.7 g/l of sodium percarbonate (from Degussa) were dissolved in water of hardness level 3. Subsequently, activator, peracid or a mixture thereof were added. The washing time was 30 min. The bleach test fabric used was curry, grass, tea and tomato on cotton (BC4, CS-8, BC-1 and CS-20, WFK, Krefeld). The bleaching result was evaluated as the difference in reflectance, measured with an Elrepho unit, after the wash in comparison with the unwashed fabric.

| | Difference in reflectance (dR %) | | | |
|---|---|---|---|---|
| Bleach (mixture) | BC-4 | CS-8 | BC-1 | CS-20 |
| 240 mg/l of TAED | 60.6 | 64.4 | 49.2 | 55.2 |
| 120 mg/l of TAED, 60 mg/l of PAP | 60.7 | 65.5 | 49.4 | 57.1 |
| 120 mg/l of PAP | 59.2 | 62.7 | 46.2 | 55.1 |

(All percentages here and in the examples below as percent by weight)

It can be seen that the inventive mixture achieves a better bleaching action than the individual activators alone.

Essentially identical results were obtained when the sodium percarbonate was replaced with sodium perborate monohydrate.

Example 2

Bleaching Performance of phthalimidoperoxycaproic acid (PAP) in Combination with tetraacetylethylenediamine (TAED)

The bleaching performance of the individual activators and of the inventive mixtures was investigated in a Linitest unit (from Heraus) at 40° C. To this end, 5 g/l of a bleach-free base washing composition (WMP, WFK, Krefeld) and 0.7 g/l of sodium percarbonate (from Degussa) were dissolved in water of hardness level 3. Subsequently, activator, peracid or a mixture thereof were added. The washing time was 30 min. The bleach test fabric used was curry, grass, tea and tomato on cotton (BC-4, CS-8, BC-1 and CS-20, WFK, Krefeld). The bleaching result was evaluated as the difference in reflectance, measured with an Elrepho unit, after the wash in comparison with the unwashed fabric.

| | Difference in reflectance (dR %) | | | |
|---|---|---|---|---|
| Bleach (mixture) | BC-4 | CS-8 | BC-1 | CS-20 |
| 240 mg/l of TAED | 67.3 | 77.3 | 56.0 | 61.4 |
| 120 mg/l of TAED, 60 mg/l of PAP | 67.9 | 77.7 | 56.5 | 67.9 |
| 120 mg/l of PAP | 63.9 | 71.8 | 48.9 | 63.9 |

It can be seen that the inventive mixture achieves a better bleaching action than the individual activators alone.

Essentially identical results were obtained when the sodium percarbonate was replaced with sodium perborate monohydrate.

Example 3

Bleaching Performance of phthalimidoperoxycaproic acid (PAP) in Combination with tetraacetylethylenediamine (TAED) in a Washing Machine The tests were performed in a Miele Novotronic W927 in a short wash cycle at 40° C. To this end, 72 g of base washing composition (WMP, WFK, Krefeld), 12 g of percarbonate (Degussa) and 5 g of TAED or 2.5 g or a mixture of 2.5 g of TAED and 1.25 g of PAP, per wash cycle were used. The test soil used was a multistain swatch (EMPA). The bleaching result was evaluated as the difference in reflectance, measured with an Elrepho unit, after the wash in comparison to the unwashed test soil.

| | Difference in reflectance (ddR %) | | | |
|---|---|---|---|---|
| Activators/activator mixture | Curry | Tomato | Red wine | Grease (stained) |
| 5 g of TAED | 43.9 | 38.2 | 27.7 | 42.0 |
| 2.5 g of TAED, 1.25 g of PAP | 48.6 | 49.2 | 28.8 | 43.9 |
| 2.5 g of PAP | 35.7 | 43.3 | 17.4 | 42.5 |

It can be seen that the inventive mixture achieves a significantly better bleaching action than the individual bleach systems alone.

Example 4

Preparation of a Cogranule from TAED and PAP

In the first step, 250 g. of a 45% aqueous Sokalan CP45 solution (commercial product from BASF AG) was mixed with approx. 312 g of water at room temperature and diluted to polymer fraction 20%. Subsequently, 138.3 g of TAED powder (without precomminution) were added stepwise and the resulting suspension was treated with the Ultra-Turrax for approx. 10 min in order to comminute the TAED crystals. The suspension prepared in this way had a somewhat increased viscosity and had to be stirred constantly to prevent sedimentations.

2) Fluidized Bed Granulation:

For laboratory experiments, a Glatt GPCG 1.1 batchwise laboratory fluidized bed with a flow diameter of D=150 mm was used, and the spray nozzles sprayed onto the fluidized bed from above.

The amount of PAP of 138.3 g and amount of TAED of 138.3 g needed to complete the formulation were initially charged in the laboratory fluidized bed together with 178.5 g of sodium sulfate (anhydrous quality). The material was fluidized with a gas flow rate of approx. 22-31 $m^3$/h, and the gas inlet temperature was approx. 60-65° C. Over a period of approx. 45 min, 588 g of the spray slurry were sprayed into the fluidized bed. A temperature in the fluidized bed of approx. 45-53° C. was established. After a continued drying time of approx. 10 min, the product withdrawn was fractionated on a laboratory screen (Retsch AS 200 control) in order to remove fines of <200 μm and coarse fractions of >1400 μm from the target product. The finished granule was present with a composition of approx. 39.3% TAED, approx. 19.7% PAP, approx. 25% sodium sulfate and approx. 16% polymer binder.

The invention claimed is:

1. A bleach mixture consisting of a) a compound of the formula (1)

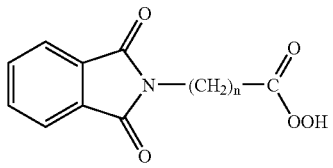

(1)

in which n is 5, and b) tetraacetylethylenediamine, and c) a component selected from the group consisting of a carrier, a binding agent, a stabilizing agent, a granulating agent, a coating agent, and mixtures thereof, wherein a weight ratio of component b) to component a) is 2:1.

2. The bleach mixture as claimed in claim 1, which is present in formulated form.

* * * * *